United States Patent [19]

Morizzo

[11] Patent Number: 4,630,339

[45] Date of Patent: Dec. 23, 1986

[54] METHOD AND APPARATUS FOR INSPECTING A LENGTH OF MATERIAL

[75] Inventor: Nicholas L. Morizzo, Cornwall, N.Y.

[73] Assignee: Krantz America, Inc., Charlotte, N.C.

[21] Appl. No.: 606,917

[22] Filed: May 4, 1984

[51] Int. Cl.[4] ..... D06H 3/04

[52] U.S. Cl. ..... 26/70

[58] Field of Search ..... 26/70; 226/90; 356/238, 356/429–431

[56] References Cited

U.S. PATENT DOCUMENTS

| | | | |
|---|---|---|---|
| 1,080,517 | 12/1913 | Miller | 226/90 |
| 2,050,053 | 8/1936 | Graf et al. | 226/90 |
| 3,299,484 | 1/1967 | Pernick | 26/70 |

FOREIGN PATENT DOCUMENTS

| | | | |
|---|---|---|---|
| 1135532 | 12/1956 | France | 26/70 |

*Primary Examiner*—Robert R. Mackey

*Attorney, Agent, or Firm*—Shefte, Pinckney & Sawyer

[57] ABSTRACT

Method and apparatus for inspecting sheetlike material such as textile fabrics, the apparatus comprising a frame in which a full roll of fabric material is arranged in spaced relation to an empty spindle or bobbin which is driven, the material extending between the full roll and the empty spindle with a generally horizontal reach. An inspection board is mounted in the frame for movement along track elements, such movement being from a first position beneath the reach of material to a second position at the upper portion of the frame. During the movement of the inspection board, it engages the reach of material and properly positions the material on the inspection board when it arrives at the second position, at which the material is visually inspected by driving the empty spindle. Conveyor means may be provided from moving full rolls of material to and from the frame, and an arrangement is provided to permit the inspection board to carry a reserve empty spindle from the preceding inspection cycle for use in a subsequent inspection cycle.

19 Claims, 5 Drawing Figures

METHOD AND APPARATUS FOR INSPECTING A LENGTH OF MATERIAL

BACKGROUND OF THE INVENTION

In the manufacturing and processing of sheetlike material, it is often necessary or desirable to inspect such material for the purpose of detecting any defects in the material before it is shipped to the customer or utilized in further process steps. Thus, in the textile industry, it is common practice for predetermined lengths of fabric to be passed over an inspection board, which may be provided with backlighting, to permit an operator to visually inspect the fabric as it is moved along the surface of the inspection board.

Typical apparatus utilized for this purpose includes a frame having a pair of spaced elements for rotating the spindle of a fully wound roll of fabric and an empty spindle is rotatably mounted in the frame to permit the cloth to be wound thereon as it is unwound from the full roll. A generally flat inspection board is mounted in fixed relation to the frame above the two spindles, and a plurality of idler rollers, usually four, are rotatably mounted in the frame, two being located at the ends of the inspection board to provide a smooth flow of fabric across the flat surface of the inspection board, and two being located between the inspection board and the two spindles to guide the fabric in its path of movement towards and away from the inspection board, and to impose the desired tension on the fabric as it moves across the inspection board.

In utilizing this conventional inspection equipment, a full roll of fabric is manually carried to the frame and mounted thereon for rotation, and the exposed end of the fabric is manually pulled by an operator to partially unwind a length of the fabric, and the operator then manually threads the fabric end around and over the plurality of idler rollers and over the surface of the inspection board until the end is finally wound onto the empty spindle. The operator then energizes a drive motor which rotates the empty spindle to pull the fabric across the surface of the inspection board to permit inspection of the fabric by the operator. It will be appreciated that this manual threading of the fabric end about the several idler rolls and the inspection board is time consuming, usually taking almost half of the total time required to complete the entire inspection cycle of a typical roll of fabric, usually between 7 and 10 minutes depending on the motivation of the operator. Also, since the full rolls of fabric are quite heavy, it is common practice for one relatively strong employee to be assigned the task of manually carrying the full rolls to a plurality of inspecting frames, and additional time may be lost in waiting for the delivery of a full roll to an inspecting frame that is otherwise ready for operation.

In an effort to maximize the efficiency of the inspection process, the full rolls are usually wound with as much fabric as possible to reduce the number of threading operations which must be carried out each time a roll is exhausted. Therefore, the full rolls are as heavy as will be permitted for manual carrying of the full rolls to and from the frame, and it is therefore desirable to locate the supports for the rolls at or near the bottom of the frame to reduce as much as possible the necessity that the heavy full rolls be lifted to an elevated position. On the other hand, since the fabric is to be visually inspected, it is desirable to locate the inspection board at an elevated position in the frame so that it will be at the approximate eye level of the operator standing adjacent to the frame. This results in a relatively substantial spacing between the spindles and the inspection board, which increases the time required to manually thread the fabric through the inspection frame at the beginning of each cycle.

In accordance with the present invention, the aforesaid drawbacks of conventional inspection apparatus are alleviated by a unique arrangement that reduces significantly the time required to carry out the inspection of fabric as well as the manual operations associated with such inspection.

SUMMARY OF THE INVENTION

Briefly summarized, the present invention provides a method and apparatus for permitting inspection of a length of sheetlike material, such as textile fabrics and the like, which includes an arrangement that has one full roll of the material wound on a spindle or bobbin and an empty spindle or bobbin onto which the material is wound as it is unwound from the full roll, the full roll and the empty spindle being arranged in spaced relationship so that a reach of said material extends therebetween. The inspection board, which includes a surface for supporting the material during inspection thereof, is arranged for movement with respect to the material, rather than being fixed as is the case in conventional fabric inspecting apparatus. An operating arrangement is provided for selectively moving the inspection board alternately between a first position at which it is disposed at one side of the plane of the reach of the material, and a second position beyond the other side of the plane of the reach of material at which the surface portion of the inspection board is disposed at an acute angle to vertical with the material being supported thereat for inspection, the material being positioned along the surface portion of the inspection board during movement of the inspection board from its first position to its second position. Thus, by virtue of this arrangement, it is the controlled movement of the inspection board itself which properly positions the material thereacross for inspection as the empty spindle is driven to unwind the material on the full roll, and the time consuming chore of threading the material around idler rolls and the inspection board itself are eliminated.

In the preferred embodiment of the apparatus of the present invention, a generally rectangular frame having a vertical extent is provided, and a cradle is located near the bottom of the frame for receiving the full roll of material and for supporting such roll during rotation thereof as it is unwound during inspection. A mounting arrangement for an empty spindle is also located near the lower portion of the frame in spaced relation to the cradle so that the reach of material extending between the full roll and the empty spindle is in a generally horizontal plane. The operating arrangement for the inspection board preferably includes a first pair of track elements disposed, respectively, beyond the side edges of the reach of material, and having a curved extent that permits these track elements to be accommodated in the lower portion of the frame beneath the reach of material. A second pair of track elements having a generally linear extent are arranged in the upper portion of the frame, these track elements also being located beyond the side edges of the reach of material and being mounted for selective movement between one position at which one end of the track elements abuts an end of the curved track elements, and a second position at which they are spaced from the curved track elements and assume a position extending at an angle with respect to vertical. The inspection board consists of two components having a pivotal connection therebetween at the approximate midpoint along the length of the inspection board, and cam rollers are provided at the sides of the inspection board to be received in the aforementioned track elements so that movement of the inspection board is guided by the movement of the cam rollers within the track elements. The inspection board is initially positioned within the lower or curved track elements so as to be disposed beneath the reach of material, and it is then moved upwardly along said curved track elements so that the inspection board engages the reach of material during such upward movement and carries such material with it. During this movement, the second or linear track elements are disposed in their position abutting the curved track elements so that the inspection board, during the upward movement thereof, is transferred from the curved track elements to the linear track elements, and when the inspection board is located in its uppermost position, fully contained within the linear track elements, the linear track elements may be moved to their second position to properly position the inspection board and the material extending thereacross at a disposition to permit proper inspection of the cloth by an operator standing adjacent the frame. When this movement of the inspection board is completed, the drive for the empty spindle is energized to thereby cause the material to be unwound from the full roll and onto the empty spindle, with the cloth moving along the surface portion of the inspection board for inspection by the operator. When the full roll is exhausted, the inspection board is returned to its initial position in the curved track elements by reversing the pattern of movement described above, and the apparatus is then ready to receive a new full roll, and the inspection cycle is repeated.

In accordance with a further feature of the present invention, the cradle for the full roll is provided with a selectively operable spindle release arrangement which permits the spindle of the full roll, after the material has been exhausted therefrom during inspection, to be released from the cradle, and the inspection board is provided with an arrangement for releasing and engaging this released empty spindle, whereby the empty spindle is carried with the inspection board during its upward movement, and when the inspection board reaches its upper or inspection position, it is located in the general vicinity of the mounting arrangement for the empty spindle so that the operator, at the conclusion of an inspection cycle, can remove the empty spindle carried by the inspection board and place it in the mounting arrangement for the empty spindle which is located nearby.

In accordance with a further feature of the present invention, a conveyor may be located adjacent to and above the full roll cradle, so that a plurality of full rolls can be arranged serially on the conveyor and selectively dropped into the cradle at the beginning of each inspection cycle, and a further conveyor may be disposed immediately below the empty spindle mounting arrangement so that when the empty spindle is fully wound with material after inspection thereof, the operator can simply move this roll directly to the conveyor with very little lifting of the roll.

DESCRIPTION OF THE PREFERRED EMBODIMENT

Figure 1:
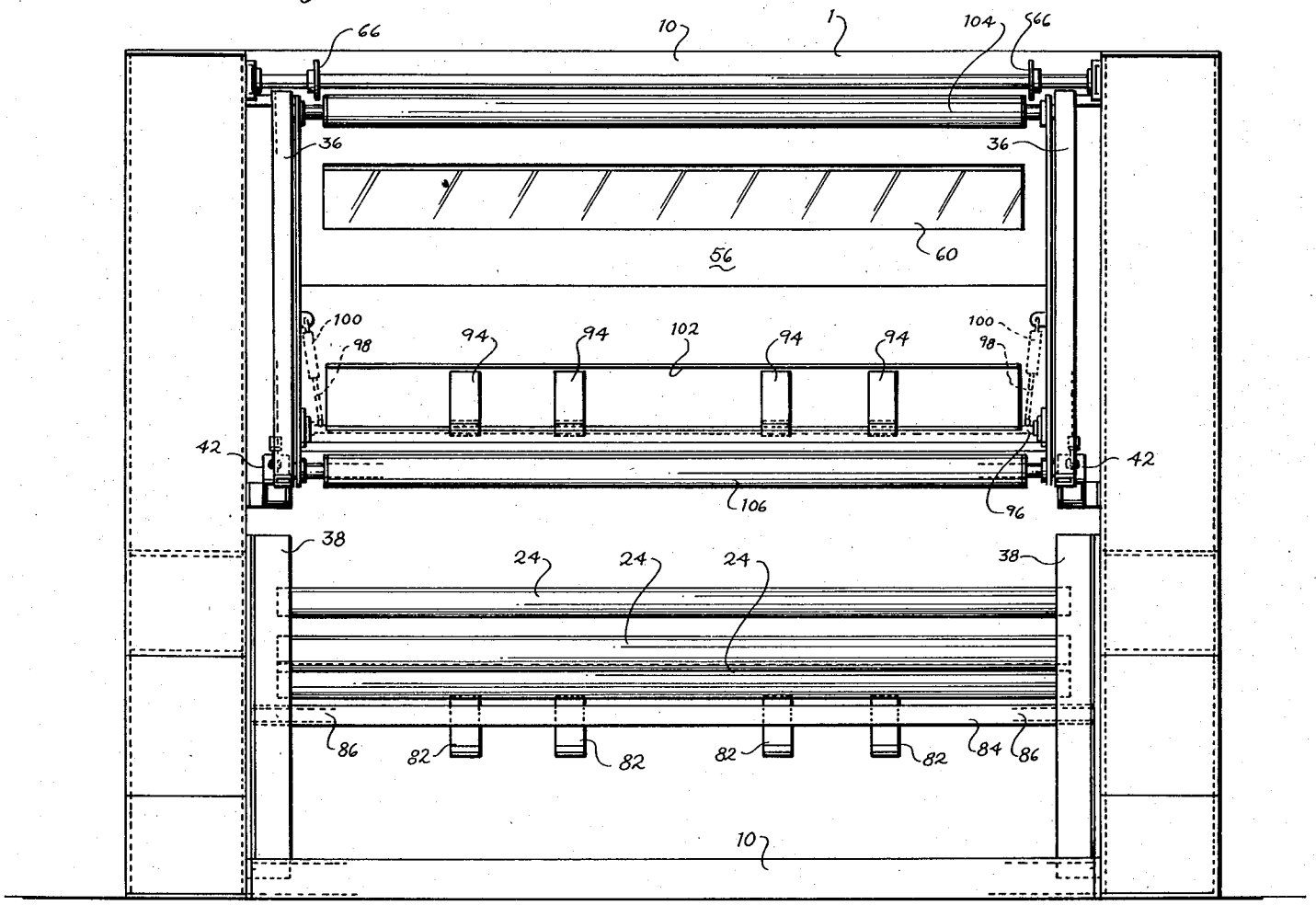
FIG. 1 is a front elevation view, in diagrammatic form, of apparatus embodying the present invention, with some of the components of the apparatus being omitted for clarity of illustration.

Looking now in greater detail at the accompanying drawings, the apparatus embodying the present invention is illustrated and includes a generally rectangular frame 10 having vertical walls 12 extending upwardly from the floor. A selectively operable conveyor belt 14 extends horizontally into one side of the frame 10 (see FIG. 2), such conveyor belt 14 extending around a drum 16 driven by a drive motor 18, the conveyor belt being arranged to support one or more full rolls 20 of material thereon and being located slightly above and adjacent to a cradle 22 which is formed by a plurality of support rollers 24 that extend across the width of the frame 10 for rotational mounting therein, the support rollers 24 being arranged in a semicircular pattern having a diameter slightly greater than the diameter of a full roll 20. In looking at FIG. 2, it will be appreciated that when the conveyor drive motor 18 is energized, a full roll 20 of material will be moved toward the cradle 22 and dropped therein so that it is supported for rotational movement by the support rollers 24. It will also be apparent that the semi-circular arrangement of the support rollers 24 will serve to support the roll 20 even as its diameter decreases during unwinding of the fabric material during inspection, as will be explained in greater detail below. A conventional spindle or bobbin mounting device 26 is also mounted in the frame 10 in spaced relation to the cradle 22 (see FIG. 2), with the rotational axis of the empty spindle mounting device 26 being preferably located in a horizontal plane containing the axis of rotation of a full roll 20 supported in the cradle 22 so that a reach of material may extend in a generally horizontal plane from the full roll 20 to an empty spindle 28 contained in the mounting device 26. A drive motor 30 is supported in the frame and connected to the spindle mounting device 26 by a chain drive 32, whereby when the drive motor 30 is energized the empty spindle 28 will be positively driven to cause material on the full roll 20 to be unwound therefrom and wound onto the empty spindle 28.

A first pair of curved, generally semi-circular, track elements 34 are mounted, respectively, at the sides of the frame 10 and in facing relationship, the spacing between the two curved track elements 34 being greater than the width of the material on the full rolls 20 (which is typically 64 inches, but can be as much as 120 inches)

so that the curved track elements 34 do not interfere with the movement of the material from the full roll 20 to the empty spindle 28 during unwinding of the material. A second pair of straight track elements 36 are located in the upper portion of the frame 10 in spaced relation to one another corresponding to the spaced relation between the curved track elements 34, the upper ends of the straight track elements 36 being supported in the frame 10 at fixed pivot points 38 and the lower ends of the straight track elements 36 being connected pivotally to the piston rod 40 of a conventional pneumatic or hydraulic cylinder 42 which is operable to selectively extend or retract the piston rod 40 to thereby move the straight track elements 36 about their respective pivot points 38. A separate cylinder 42 is provided for each of the two straight track elements to move them in unison, and it will be noted that the cylinders 42 are mounted in the frame by a pivotal connection 44 to permit some rotational movement of the cylinder 42 about the pivot connection 44 during movement of the straight track elements 36 as will be described in greater detail below.

An inspection board 46 is provided, and it includes two support elements 48 pivotally connected to a pair of cam rollers 50 located at the midpoint of the inspection board 46 along the length thereof. A pair of corresponding cam rollers 52 are also mounted at each side of the upper end of the inspection board 46, and a further pair of cam rollers 54 are located at the sides of the lower end of the inspection board 46, with each pair of cam rollers 50,52 and 54 being received within the curved track elements 34 in the position of the inspection board 46 illustrated in FIG. 2. When the two support elements 48 of the inspection board 46 are arranged in linear relationship to one another (see FIGS. 3 and 4), they form a flat support surface 56 for supporting the fabric material during inspection thereof, and one of the support elements 48 is preferably provided with a housing 58 in which lighting elements (not shown) are mounted, and the housing 58 includes a clear plastic or glass wall portion 60 which forms part of the support surface 56 and which permits light from the housing 56 to be emitted through the wall portion 60 to facilitate inspection of the fabric material moving thereacross. The upper end of the inspection board 46 is fixed to a chain 62 that extends in a closed path around an idler sprocket 64 and a drive sprocket 66 located adjacent the top of the frame 10, the drive sprocket 66 being selectively driven by a drive motor 68 through a chain 70, to raise and lower the inspection board 46 in a manner to be described presently.

Figure 2:
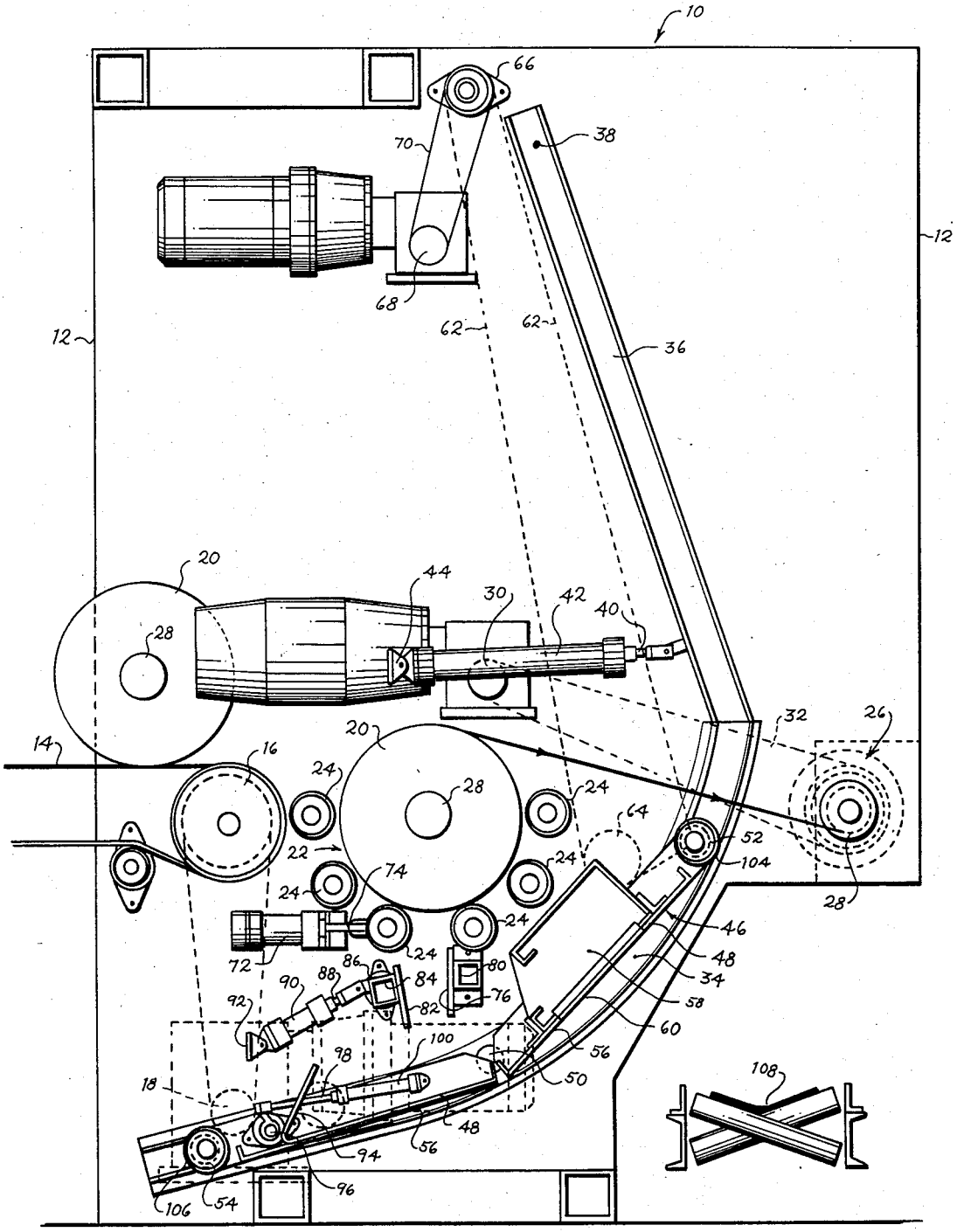
FIG. 2 is a side elevational view, in diagrammatic form, of the apparatus shown in FIG. 1, with the inspection board being located in its initial or lowermost position.

The cradle 22 includes an arrangement for releasing the empty spindle 28 of a full roll 20 after the fabric material has been exhausted therefrom during inspection, such arrangement including a pneumatic or hydraulic cylinder 72 having an extendable piston 74 connected to one of the lowermost support rollers 24 (see FIG. 2) so that retraction of the piston 74 by the cylinder 72 will move one of the lowermost support rollers 24 away from another by a sufficient distance to permit an empty spindle 28 to drop or pass therebetween. A plurality of first retainer plates 76 are mounted in spaced relation along a fixed tubular element 80 that extends across the width of the frame 10 just below one of the support rollers 24, and a like plurality of moveable retainer plates 82 are likewise mounted on a second hollow tubular member 84 that extends across the width of the frame 10, such second tubular element 84 being mounted for rotational movement on a shaft 86 which is connected to the piston 88 of a hydraulic or pneumatic cylinder 90 mounted in the frame 10 at a pivotal connection 92, so that extension and retraction of the piston 88 will cause rotation of the shaft 86 and tubular support 84 which, in turn, causes the moveable retainer plates 82 to be moved with respect to the fixed retainer plates 76. In their normal positions (see FIG. 5), the fixed retainer plates 76 and moveable retainer plates 82 are positioned to form a generally V-shaped pocket for receiving an empty spindle 28 or bobbin when the aforesaid lowermost support roller 24 is moved by its pneumatic or hydraulic cylinder 72 to release an empty spindle 28 from the cradle 22, the spacing between the bottom ends of the fixed retainer plates 76 and moveable retainer plates 82 being less than the diameter of an empty spindle 28 so that the empty spindle 28 released from the cradle 22 will be retained between these plates. The inspection board 46 is provided with a plurality of V-shaped carrier members 94 mounted in spaced relation along the length of an operating shaft 96 that extends across the width of the inspection board 46 and is mounted for rotation therein, the operating shaft being connected at each end thereof to the pistons 98 of pneumatic or hydraulic cylinders 100 which are mounted in the inspection board 46 beneath the support surface 56 thereof. The support surface 56 of the inspection board 46 is provided with an opening 102 extending across the width of the inspection board 46 (see FIG. 1), and one side of each of the V-shaped carrier members 94 is normally disposed in said opening with the exposed surfaces thereof being in planar relation with the support surface 56. As best seen in FIG. 2, when the inspection board 46 is in its lowermost position, the carrier members are positioned beneath the support surface 56 and in the general vicinity of the fixed and moveable retainer plates 76 and 82, so that when an empty spindle 28 is released therefrom such spindle will roll down the underside of the inspection board 46 and be received and retained in the V-shaped carrier members 94. Moreover, during upward movement of the inspection board 46 (see FIGS. 3 and 4), the empty spindle 28 is retained by the carrier members 94 so as to move with the inspection board 46 during such upward movement thereof. It will also be noted that the inspection board 46 includes an idler roller 104 located at the upper end thereof and extending across the width of the inspection board 46 to provide a rotating support surface for the material as it moves across the support surface 56, and a similar roll 106 is located at the bottom end of the inspection board 46. Finally, a second conveyor 108 is positioned directly beneath the spindle mounting device 26 so that when an inspection cycle is completed, the operator can readily remove the full roll of material from the spindle mounting device 26 directly to the second conveyor 108 without any significant lifting or handling of the full roll, and, if desired, the frame 10 may be provided with any suitable guide tracks (not shown) extending from the spindle mounting device 26 to the second conveyor 108 that will permit the operator to simply drop the full roll into the guide tracks which will carry the full roll directly to the second conveyor 108.

Figure 3:
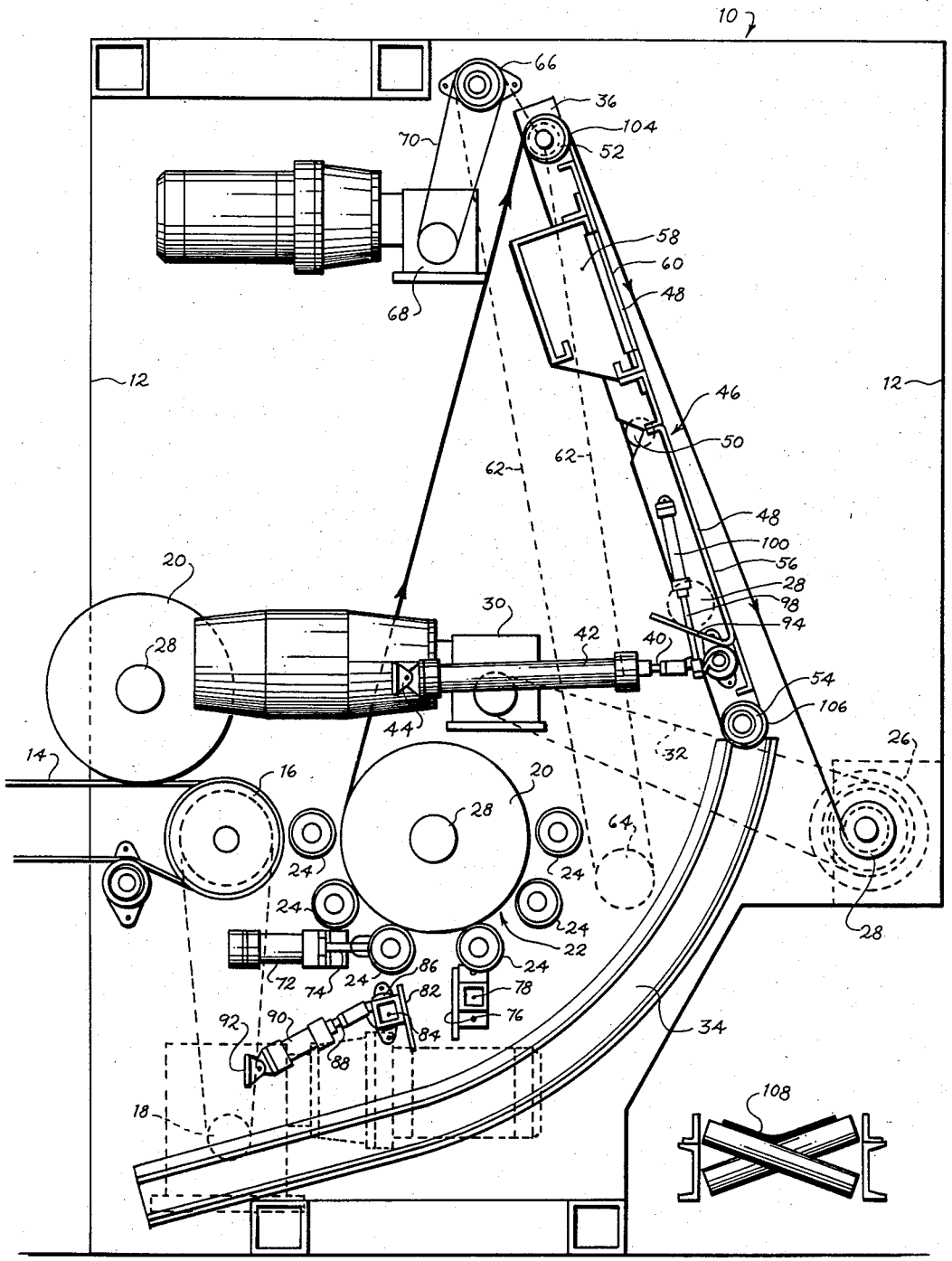
FIG. 3 is a side elevational view similar to FIG. 2, and showing the inspection board in its intermediate raised position.
Figure 4:
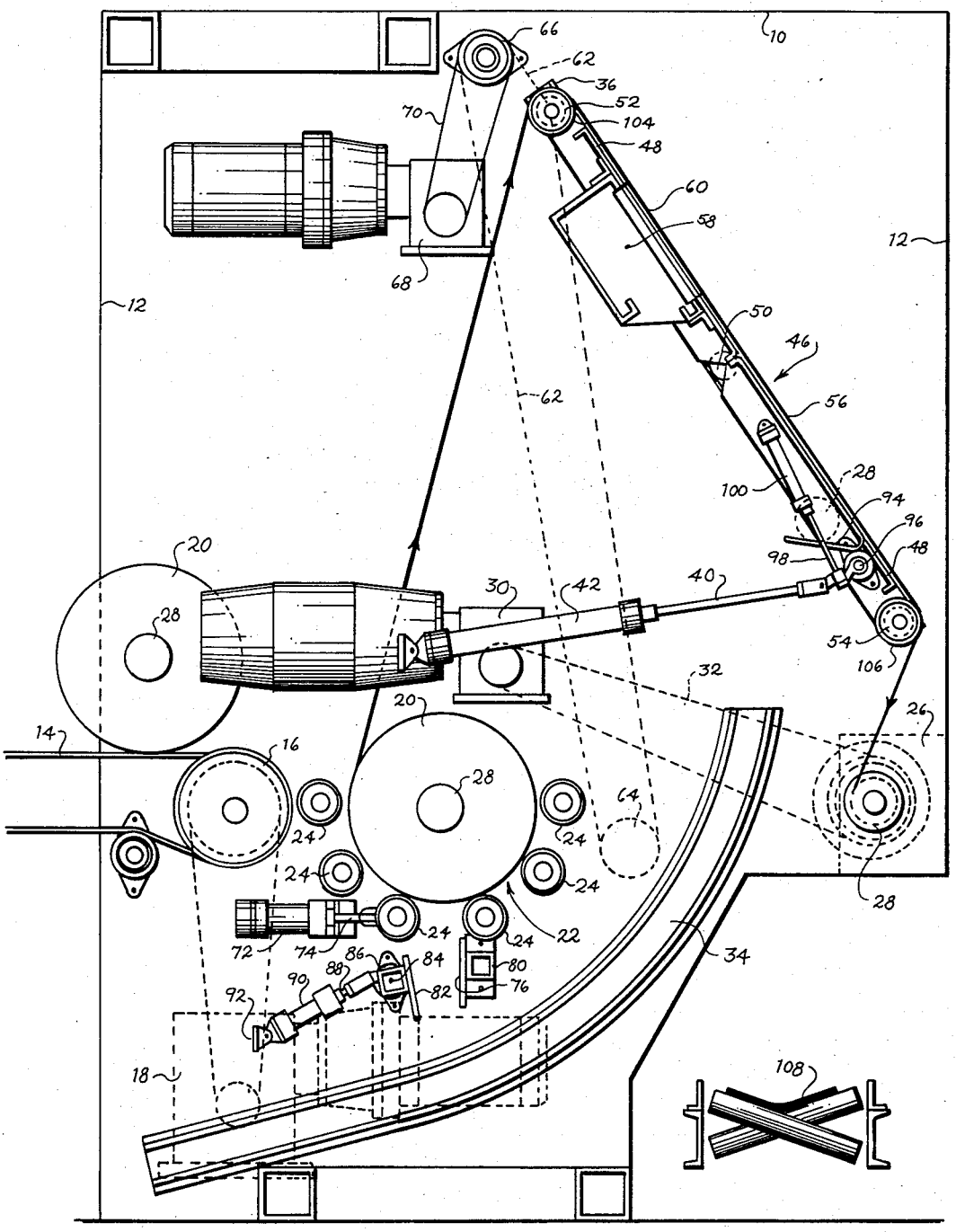
FIG. 4 is a side elevational view similar to FIG. 2, and illustrating the inspection board at its operating position during inspection of the material.
Figure 5:
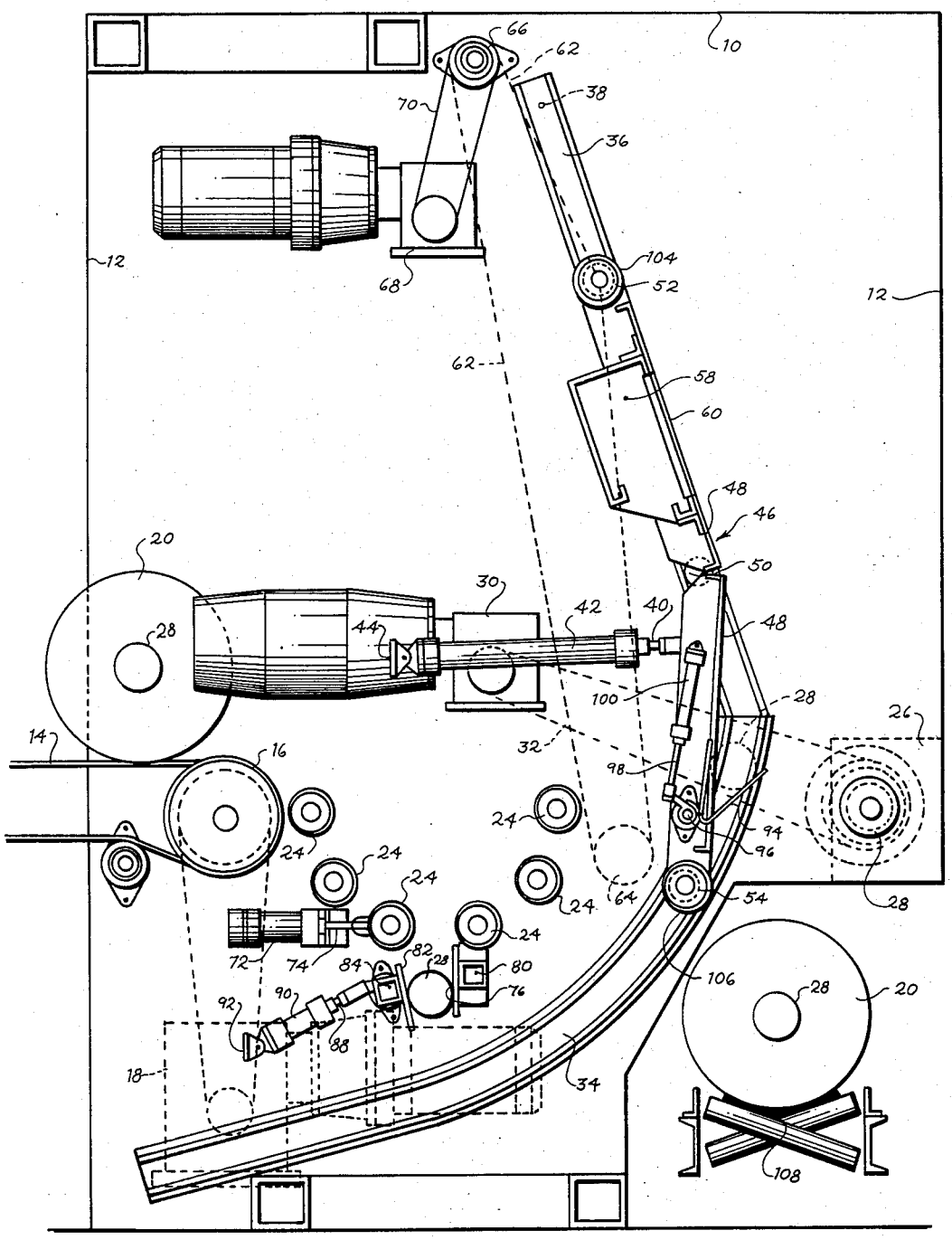
FIG. 5 is a side elevational view similar to FIG. 2, and showing the inspection board at a further intermediate position during its return movement to the lower portion of the frame.

The sequential operation of the above-described apparatus is illustrated in FIGS. 2–5. FIG. 2 illustrates the apparatus at the beginning of a cycle, and the operator energizes the drive motor 18 for the conveyor belt 14 so that a full roll of material 20 is carried to and deposited in the cradle 22. The operator grasps the exposed end of material on the full roll 20 and pulls it sufficiently to engage such end at an empty spindle 28 or bobbin mounted in the spindle mounting device 26, thereby forming a reach of material extending from the full roll 20 to the empty spindle 28, such reach being in a generally horizontal plane. It will be noted that in FIG. 2 the inspection board 46 is fully contained within the curved track elements 34, the pivotal arrangement between the two support elements 48 permitting the support elements to assume an angular relationship to one another so that the inspection board 46 can be accommodated in the curved track elements 34 beneath the plane of the reach of material even though the full roll 20 and the empty spindle 28 are located near the bottom portion of the frame 10 so as to eliminate any significant lifting of the full rolls of material during handling thereof. It will also be noted that at the beginning of the cycle, the straight track elements 36 are positioned with the lower end thereof in abutment with the upper end of the curved track element 34 to form a continuous guide path therewith. The drive motor 68 is then energized to cause the chain 62 to raise the inspection board 46, and the cam rollers 50,52 and 54 move in the curved track elements 34 and the straight track elements 36 to cause the inspection board 46 to move into the straight track elements 36 and ultimately assume the position totally within the straight track elements 36 as shown in FIG. 3. During this upward movement of the inspection board 46, the idler roll 104 at the upper end thereof engages the reach of material and carries such material with it during this upward movement, the material unwinding from the full roll 20. After the inspection board 46 has reached the raised position shown in FIG. 3, the cylinder 42 is energized to extend the piston 40 and cause pivotal movement of the lower end of the inspection board 46 and the straight track elements 36 about the upper pivot point 38 until the straight track elements 36 and the inspection board 46 assume the position shown in FIG. 4. At this position, the inspection board 46 and the support surface 56 thereof are disposed at a predetermined acute angle with respect to vertical, such angle being selected to properly present the material passing thereover for visual inspection at the eye level of an operator standing adjacent the front of the apparatus, which would be the right hand side of the apparatus as shown in FIG. 4. The drive motor 30 for the spindle mounting device 26 is then energized to rotate the empty spindle 28, which causes the material to be unwound from the full roll 20, to pass over the upper idler roll 104, along the support surface 56 at which the material is supported during such movement, and then around lower idler roll 106 for wind up on the driven empty spindle 28. During this movement of the material, it is supported on the support surface 56 and generally held thereat by the path of movement of the material about the idler rolls 104 and 106, and the material can be readily inspected by the operator. After the material has been inspected and is fully contained on the spindle 28 in the spindle mounting device 26, the operator can remove this full roll of material from the spindle mounting device 26 and deposit it onto the second conveyor 108 located closely adjacent thereto. The cylinder 42 is then energized to retract its piston 40 and pivot the straight track elements 36 back to their position in abutment with the upper ends of the curved track elements 34 as shown in FIG. 3. The chain drive motor 68 is then energized to permit the inspection board 46 to move downwardly under the force of gravity, or to be driven downwardly by the chain drive motor 68, and into the curved track elements 34. In the preferred operation of the apparatus of the present invention, this downward movement of the inspection board 46 is stopped when the inspection board 46 reaches a predetermined position as shown in FIG. 5, where it is intermediate its upper and lower positions. It will be noted that at this intermediate position, the V-shaped carrier members 94 in the inspection board 46 are located immediately adjacent the spindle mounting device 26, and the operator can energize the cylinder 100 to cause outward pivoting movement of the V-shaped carrier members 94 so that the reserve spindle 28 carried in the V-shaped carrier members 94 can be lifted therefrom by the operator and moved the short distance to the spindle mounting device 26 for mounting therein. The V-shaped carrier members 94 are then pivoted back to their original position beneath the support surface 56 of the inspection board 46, and the chain drive motor 68 is again energized to permit the inspection board 46 to return fully to its lowermost position as shown in FIG. 2. During this return movement of the inspection board 46, the cylinder 72 is energized to retract its piston 74 whereby the lowermost support roller 24 in the cradle 22 is moved away from the other lowermost support roller 24 to release the now empty spindle 28 or bobbin carried in the cradle 22, this now empty spindle 28 dropping into the fixed retainer plates 76 and the moveable retainer plates 82 so as to be held therebetween as illustrated in FIG. 5. After the inspection board 46 is returned to its initial position within the curved track elements 34 as shown in FIG. 2, the cylinder 90 is energized to rotate the shaft 86 to cause pivotal movement of the moveable retainer plates 82 to thereby release the empty spindle 28, so that it drops onto the inspection board 46 to be received and retained by the V-shaped carrier members 94. A new full roll 20 may also be dropped into the cradle 22 by the conveyor belt 14 during the return movement of the inspection board 46, after the empty spindle 28 in the cradle 22 has been released from the cradle 22, and a new cycle is commenced.

If desired, the operational step by which the inspection board 46 is stopped at an intermediate position during its return movement as illustrated in FIG. 5 could be eliminated, and the outward pivotal movement of the V-shaped carrier members 94 could be carried out at the position of the inspection board shown in FIG. 4, it being noted that even at this position of the inspection board 46, the reserve spindle 28 carried by the carrier members 94 is relatively close to the spindle mounting device 26 so that the operator would have little difficulty in removing the reserved spindle 28 from the carrier members 94 and placing it in the spindle mounting device 26. Also, if desired, the actuation of the cylinder 90 for the moveable retainer plates 82 could be times so that the empty spindle 28 retained between the fixed retainer plates 76 and the moveable retainer plates 82 is released therefrom just after the V-shaped carrier members 94 have moved past the retainer plates 76 and 82 during return movement of the inspection board 46, whereby the empty spindle 28 will be released directly into the V-shaped carrier members 94.

Thus, in accordance with the present invention, it will be noted that the positions of the rolls of material to be inspected are located in the lower portion of the frame 10 so that little or no lifting of heavy full rolls of material to elevated heights is required. On the other hand, the inspection board 46 is automatically raised during operation of the apparatus to an elevated position, carrying the material with it during such movement, so that the inspection board 46 is ultimately disposed at the upper portion of the frame 10 at the eye level of the operator to permit visual inspection of the material moving across the support surface 56 of the inspection board 46, and this support surface 56 is properly disposed at an angle to vertical which will facilitate a proper visual inspection of such material. It is particularly significant to note that the automatic upward movement of the inspection board 46 engages the material and carries such material with it in a manner that will automatically and properly position the material on the support surface 56 of the inspection board 46, and the operator is not required to carry out any time consuming threading of the material about idler rolls and the inspection board 46 as is presently required in conventional cloth inspection apparatus of the type described above. By virtue of this operational characteristic of the present invention, the time required to complete the inspection cycle of a typical full roll of material is significantly reduced. As indicated above, a complete inspection cycle normally takes between 7 and 10 minutes using conventional cloth inspection apparatus, whereas it is expected that the total time required for an inspection cycle using the present invention will be as little as 3½ minutes. Thus, the present invention offers significant advantages in terms of time saving and efficiency, and reduces significantly the burdensome task of manually lifting and carrying the full rolls of materials during the various steps of the inspection operation.

The present invention has been described in detail above for purposes of illustration only and is not intended to be limited by this description or otherwise to exclude any variation or equivalent arrangement that would be apparent from, or reasonably suggested by the foregoing disclosure to the skill of the artisan.

I claim:

1. Apparatus for permitting inspection of a length of sheetlike material such as textile fabrics and the like, said apparatus including:

a. mounting means for mounting a pair of spindles in spaced relation to one another with said material being initially wound onto one of said spindles to provide a reach of said material extending in a generally horizontal plane between said spindles, and selectively operable drive means for operating said spindles to cause said material to be unwound from said one of said spindles and onto the other of said spindles;

b. supporting means having a generally flat surface portion across which said material is moved to permit inspection thereof;

c. means for mounting said supporting means at a first position disposed on one side of said plane of said reach of material; and d. operating means for selectively moving said supporting means and its flat surface portion from said first position in a direction upwardly and through said generally horizontal plane of said reach of material to a second position at the other side of said plane, said operating means including means for disposing said flat surface portion of said supporting means at an acute angle with respect to vertical when said supporting means is at said second position thereof.

2. Apparatus for permitting inspection of a length of sheetlike material as defined in claim 1 and further characterized in that said operating means includes guide track means disposed beyond the edges of said reach of material, and in that said supporting means includes guide roller means received in said guide track means for movement therein, said guide track means being formed to direct the movement of said supporting means between said first and second positions thereof.

3. Apparatus for permitting inspection of a length of sheetlike material as defined in claim 2 and further characterized in that said guide track means includes a first track portion for receiving said supporting means at said first position thereof, and a second track portion for receiving said supporting means at said second position thereof.

4. Apparatus for permitting inspection of a length of sheetlike material as defined in claim 3 and characterized further in that at least a major part of said first track portion is disposed at said one side of said reach of material, and in that at least a major part of said second track portion is located at the other side of said reach of material.

5. Apparatus for permitting inspection of a length of sheetlike material as defined in claim 3 and characterized further in that said flat surface disposing means includes track moving means for selectively moving said second track portion between one position at which one end thereof abuts an end of said first track portion to permit movement of said supporting means therebetween, and another position at which it is spaced from said first track portion where said supporting means is supported solely by said second track portion.

6. Apparatus for permitting inspection of a length of sheetlike material as defined in claim 3 and characterized further in that said first track portion has a curved extent, and in that said supporting means is comprised of pivotally connected elements that permit said supporting means to follow the contour of said curved first track portion during movement therein.

7. Apparatus for permitting inspection of a length of sheetlike material as defined in claim 1 and characterized further in that cradle means is provided for supporting said one spindle with said material wound thereon at the circumferential surface thereof during rotation of said one spindle as material is unwound therefrom.

8. Apparatus for permitting inspection of a length of sheetlike material as defined in claim 7 and characterized further in that said cradle means includes selectively operable release means for releasing said one spindle after the material has been unwound therefrom.

9. Apparatus for permitting inspection of a length of sheetlike material as defined in claim 8 and characterized further in that said supporting means includes receiver means for receiving said spindle released by said release means, said receiver means engaging said spindle so that it is carried with said supporting means during its movement from said first position to said second position thereof.

10. Apparatus for permitting inspection of a length of sheetlike material as defined in claim 9 and characterized further in that said receiver means is mounted in said supporting means by pivot means for selective movement to a position at which said spindle engaged thereby can be removed therefrom at said surface portion of said supporting means when said supporting means is located at a predetermined position during said movement thereof.

11. Apparatus for permitting inspection of a length of sheetlike material as defined in claim 10 and characterized further in that said drive means rotates said other spindle and is disposed at a location adjacent to said receiver means of said supporting means when said supporting means is at said predetermined position thereof, whereby said spindle removed from said receiver means can be easily moved to said drive means for mounting therein.

12. Apparatus for permitting inspection of a length of sheetlike material as defined in claim 7 and characterized further in that said apparatus includes conveyor means for delivering supply rolls of material wound on spindles thereto, said conveyor means being disposed adjacent to and above said cradle means and including selectively operable drive means for delivering said supply rolls serially to said cradle means.

13. Apparatus for permitting inspection of a length of sheetlike material such as textile fabrics and the like, said apparatus comprising:

a. a generally rectangular frame;

b. mounting means for mounting a pair of spindles in said frame in spaced relation to one another with said material being initially wound onto at least one of said spindles and extending to the other said spindle to provide a reach of material extending in a generally horizontal plane between said spindles, and selectively operable drive means for operating said spindles to cause said material to be unwound from one of said spindles and wound onto the other;

c. supporting means supported in said frame and having a surface portion for supporting said material during movement thereacross when said drive means is operated; and d. operating means for selectively moving said supporting means alternately between a first position adjacent the bottom of said frame, and a second position adjacent the top of said frame, said movement of said supporting means extending through said plane of said reach of material to cause said material to be engaged by said supporting means and supported at said surface portion thereof, said supporting means having first and second end portions, and said operating means moving said supporting means from said first position to said second position along a path of movement having a first phase extending in a generally vertical direction so that said first end portion of said supporting means will engage said reach of material and a second phase during which said second end portion of said supporting means is moved in a generally horizontal direction to dispose said surface portion of said supporting means at a predetermined acute angle with respect to vertical, whereby said material supported at said surface portion can be visually inspected by an operator standing adjacent to said frame.

14. Apparatus for permitting inspecting of a length of sheetlike material as defined in claim 13 and characterized further in that said operating means includes first track means located beneath said reach of material and having a curved contour extending upwardly toward said reach of material, second track means located above said reach of material and having a linear extent, and in that said supporting means includes guide roller means arranged to be received in said first and second track means to cause said movement of said supporting means between said first and second positions thereof.

15. Apparatus for permitting inspecting of a length of sheetlike material as defined in claim 14 and characterized further in that said operating means includes cable means extending from the upper portion of said frame and connected to said one end of said supporting means to move said supporting means in said first phase of said path of movement, and includes motor means connected to the other end of supporting means to move said supporting means in said second phase of said path of movement.

16. A method of manipulating a length of sheetlike material such as textile fabrics to permit visual inspection thereof, said method comprising the steps of:

a. providing a reach of said material extending between a pair of spaced spindles in a generally horizontal plane;

b. locating a material supporting member having an extending surface portion at an initial position beneath said reach of material;

c. moving said supporting member in a direction of movement extending upwardly through said plane of said reach of material to cause said material to be engaged by said supporting member and then positioning said supporting member so that said material is supported along said extending surface portion thereof;

d. driving one of said pair of spindles to cause said material to be wound onto said one spindle and unwound from the other spindle while said material is supported along said surface portion; and e. returning said supporting member to said initial position after all of said material has been wound onto said one spindle.

17. A method of manipulating a length of material as defined in claim 16 and further characterized by the step of causing said other spindle to be received and engaged by said supporting member after said material has been unwound therefrom and after said supporting member has returned to said initial position thereof, whereby said other spindle is carried by said supporting member during the next cycle of movement thereof.

18. A method of manipulating a length of material as defined in claim 16 and further characterized in that said supporting member is moved in said upward direction of movement by pulling one end of supporting member in said upward direction, and in that said positioning of said supporting member is caused by angular movement of said supporting member about said one end thereof.

19. A method of manipulating a length of material as defined in claim 16 and further characterized in that said positioning of said supporting member causes said extending surface portion thereof to be disposed at a predetermined acute angle with respect to vertical to permit inspection of the material supported thereat by an operator standing adjacent to said supporting member.

* * * * *